US007875123B2

(12) United States Patent
Crawford, III et al.

(10) Patent No.: US 7,875,123 B2
(45) Date of Patent: Jan. 25, 2011

(54) METHOD AND APPARATUS FOR CLEANING PERCOLATION BASINS

(76) Inventors: William Randall Crawford, III, 255 Marina Dr., Long Beach, CA (US) 90803; William Scott Crawford, 255 Marina Dr., Long Beach, CA (US) 90803

( * ) Notice: Subject to any disclaimer, the term of this patent is extended or adjusted under 35 U.S.C. 154(b) by 1162 days.

(21) Appl. No.: 11/396,668

(22) Filed: Apr. 3, 2006

(65) Prior Publication Data

US 2006/0225771 A1 Oct. 12, 2006

Related U.S. Application Data

(60) Provisional application No. 60/668,778, filed on Apr. 6, 2005.

(51) Int. Cl.
*B08B 5/04* (2006.01)
*B08B 7/00* (2006.01)
*B65G 5/00* (2006.01)

(52) U.S. Cl. ..... 134/21; 134/6; 210/747; 405/53; 417/87

(58) Field of Classification Search ..... 37/307, 37/308, 313, 317, 324, 326, 329, 195; 210/170.01, 210/170.02, 170.03, 170.04, 170.06, 170.09, 210/171, 271, 747; 134/16; 405/36; 136/6
See application file for complete search history.

(56) References Cited

U.S. PATENT DOCUMENTS

| | | | | |
|---|---|---|---|---|
| 4,232,903 | A * | 11/1980 | Welling et al. | 299/8 |
| 6,017,400 | A * | 1/2000 | Clark et al. | 134/21 |
| 6,709,199 | B2 * | 3/2004 | Peyton | 405/53 |
| 2004/0057839 | A1 * | 3/2004 | Crawford, III | 417/87 |
| 2004/0060849 | A1 * | 4/2004 | Peyton | 210/100 |

* cited by examiner

*Primary Examiner*—Duane Smith
*Assistant Examiner*—Paul J. Durand
(74) *Attorney, Agent, or Firm*—Bruce H. Johnsonbaugh

(57) ABSTRACT

A method and apparatus for cleaning accumulated silt from the floor of a percolation basin are provided. An underwater terrain vehicle (UTV) moves along the basin floor and carries a series of blades that cut and lift the accumulated silt. An eductor driven vacuum head also carried by the UTV vacuums fragmented silt and transports the entrained fragmented silt through a vacuum hose into a location where the silt particles are separated from the water in which they are entrained. The UTV carries a first sonar for continuously scanning the basin floor and which is utilized to guide the UTV. A second sonar is placed in the basin in a known location and continuously scans and continuously monitors the location of the UTV on the basin floor. An operator remotely guides the UTV from an onshore location.

9 Claims, 12 Drawing Sheets

METHOD AND APPARATUS FOR CLEANING PERCOLATION BASINS

CROSS-REFERENCE TO RELATED APPLICATION

This application claims the benefit of and priority from U.S. provisional application Ser. No. 60/668,778 filed Apr. 6, 2005.

BACKGROUND AND BRIEF SUMMARY

The present invention relates to the maintenance of water percolation basins. A water percolation basin is a large, man-made basin created for the purpose of capturing water such as, for example, rainwater, recycled water and/or run-off from melting snow in the mountains. These basins are particularly important in dry and/or arid portions of the country, such as Southern California. These basins range in size from several acres to several hundred acres. The purpose of the basin is not only to capture water but primarily to allow the water to percolate down through the floor of the basin and into the underground water table. The water may thereafter be pumped out of the recharged water table by various systems known in the art. The need for additional sources of water is overwhelming and does not require elaboration.

The primary problem encountered with these percolation basins is that relatively thin layers of silt or clay accumulate on the floor of the basin and dramatically reduce the ability of the water to penetrate the floor of the basin and percolate downwardly into the water table. Various efforts have been made to remove such layers to rehabilitate the percolation capacity of the floor of these basins. Unfortunately, the prior art efforts have been completely unsatisfactory and have been very expensive.

One typical prior art method requires simply waiting until the basin is dry and entering the basin with rather large machines to mechanically remove the silt or clay layer build-up from the floor of the basin. This technique is very expensive and the basin only percolates effectively for a short time.

The prior art also includes the Clark et al U.S. Pat. No. 6,017,400 for cleaning a water basin floor. Clark et al teaches a system wherein a series of water jets hydraulically agitates and fluidizes the layer of unwanted silt along with some of the porous sand underneath the silt. The fluidized silt and sand mixture is drawn upwardly through a relatively large, inclined separation chamber in which the larger sand particles are separated by gravity from the smaller silt particles. The sand particles are returned to the basin floor and the silt particles are removed from the basin.

The applicants have observed the apparatus taught by Clark et al and believe it is unsatisfactory for use in many, if not most, percolation basins for several reasons. First, the objective of separating sand from silt using gravity requires a relatively large separation chamber, which in turn limits the vacuum obtainable for removing silt particles. Secondly, the use of high pressure water jets to hydraulically agitate and fluidize the silt layer along with an underlying layer of sand will not perform well where the silt is relatively thick and dense, such as a layer of aluminum silicate clay with a thickness of 4 mm. or more. The thicker and denser the layer of silt, the less able the water jets are to agitate and fluidize the silt. If the water jet pressure is increased to penetrate a thick, dense layer of silt, an inherent result is to cause "potholes" in the basin floor, a result that is wholly unacceptable.

The present invention, in contrast to Clark et al, does not separate sand from silt and is therefore able to avoid a separation chamber and to use a much smaller underwater vehicle (less than 1% of the size of Clark et al) capable of generating a much larger vacuum adjacent the layer of silt. In further contrast to Clark et al, the present invention does not hydraulically agitate and fluidize the silt, but rather mechanically cuts and/or lifts the silt layer and then applies a large vacuum to remove the fragmented, non-fluidized silt from the basin.

A primary object of the present invention is to provide a method and apparatus for efficiently and effectively removing accumulated silt from the floor of a water percolation basin.

A further object of the invention is to provide a method and apparatus for removing accumulated fatty clay such as aluminum silicate, from the floor of a water percolation basin wherein the clay is cut and/or lifted by blades to form fragments which are immediately vacuumed and removed from the basin floor.

A further object of the invention is to provide a method and apparatus for cleaning accumulated silt from a water percolation basin floor wherein a remotely controlled underwater terrain vehicle performs the cleaning and utilizes an onboard side scanning sonar for guidance purposes.

A further object of the invention is to provide a method and apparatus for removing accumulated silt from a water percolation basin floor wherein a remotely controlled underwater terrain vehicle is equipped with an eductor driven vacuum head together with first and second rows of blades carried on either side of said vacuum head, allowing the UTV to clean the basin by moving forwardly to form a first swath and backwardly (or in reverse) to form an adjacent second swath so that the UTV does not have to make a series of 180° turns.

Further objects and advantages of the invention will become apparent from the following description and drawings wherein:

DETAILED DESCRIPTION OF THE DRAWINGS

Figure 1:
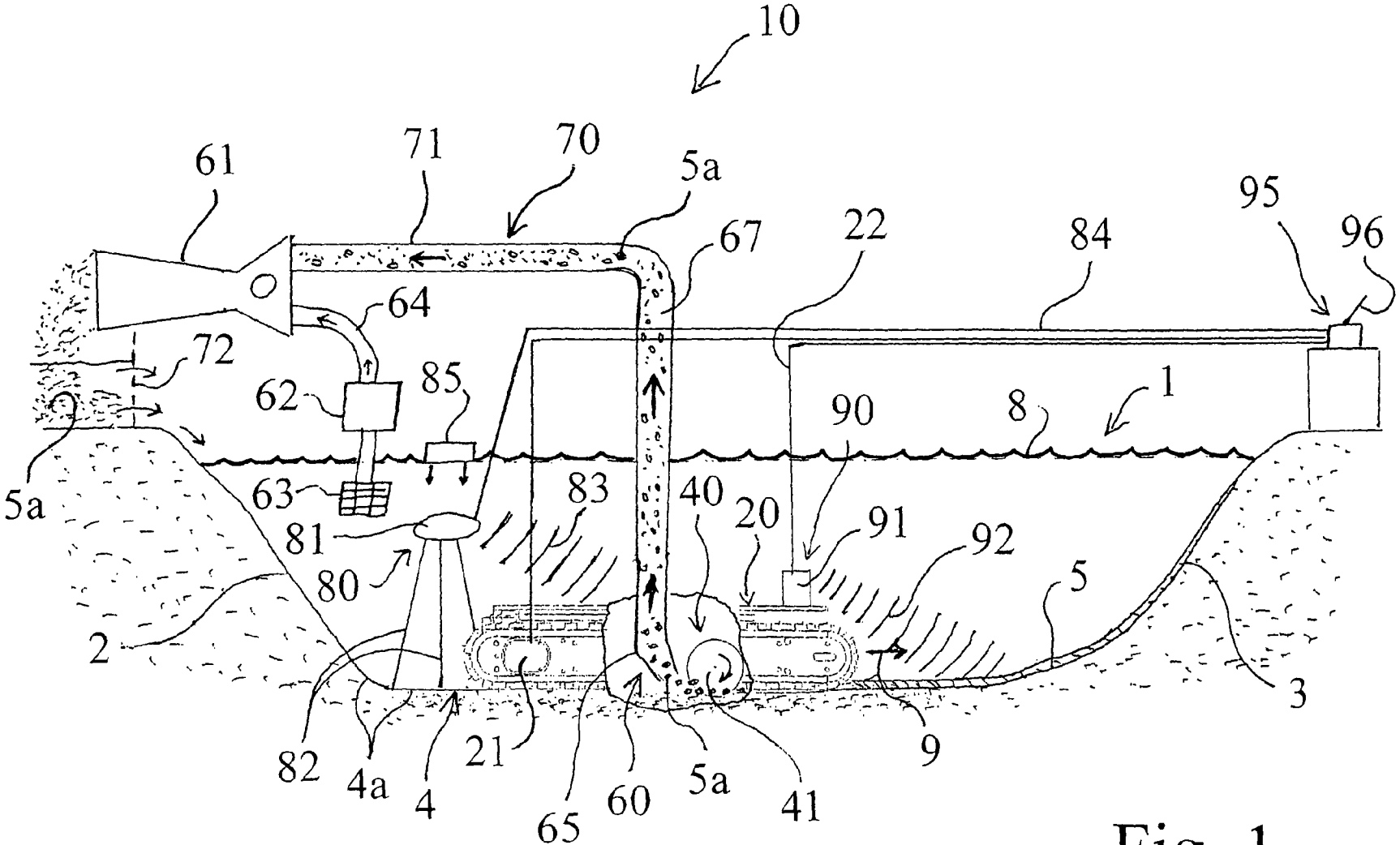
FIG. 1 is a schematic illustration (not to scale) of a first embodiment of the method and apparatus of the invention operating on a water percolation basin floor that is flat.

FIG. 1 is a schematic illustration (not to scale) of a first embodiment of the invention wherein the apparatus to be described is shown generally as 10 and is shown being used in conjunction with a percolation basin shown generally as 1 for containing water 8. FIG. 1 is not to scale and exaggerates the size of UTV 20 in order to illustrate the invention. As a practical matter, percolation basin may be 40 acres in size and the underwater terrain vehicle (UTV) 20 to be described is less than approximately 2 feet in length in most embodiments. Percolation basin 1 has inclined side walls 2 and 3 that are inclined at approximately a 30° angle. Some percolation basins have a flat floor 4 which, as described above, over time becomes clogged with a layer of silt 5. The invention to be described is capable of use in basins having flat floors, as illustrated in FIG. 1, as well as basins described and illustrated below, utilizing inclined berms formed on the basin floor. As used herein and in the claims, the word "silt" is used in a broad sense to include aluminum silicate, fatty clay and other sediment typically found in percolation basins. The fatty clay and aluminum silicate tend to form a layer of silt 5 which is dense and compact.

As shown in FIG. 1, a remotely controllable UTV 20 is shown moving to the right in the direction of arrow 9. A portion of the basin floor 4*a* to the left of UTV has previously been treated by the invention and the accumulated layer of silt 5 has been removed. The UTV 20 is shown in the process of advancing towards the accumulated silt layer 5.

A means shown generally as 40 is carried by UTV 20 for mechanically cutting and/or lifting accumulated silt from the basin floor to form silt fragments 5*a* as the UTV 20 moves along the basin floor. As shown in the embodiment of FIG. 1, means 40 includes a harrow having a plurality of circular blades, such as blade 41, that mechanically cut and partially lift accumulated silt 5. We have found that the most effective technique in removing a layer of fatty clay such as aluminum silicate is to mechanically cut the clay into strips and preferably to mechanically lift the strips slightly. The clay strips tend to fragment somewhat as they are being cut and lifted. A relatively strong eductor driven vacuum, described below, is immediately applied to the region adjacent the harrow blades (or other cutting surface) to suck the fragments into a vacuum line for transport and ultimate removal from the basin 1. No attempt is made to "fluidize" or pulverize the clay (or silt) or to otherwise reduce it to individual particles. Rather, the silt layer is mechanically cut and preferably lifted with minimal agitation, and is then immediately exposed to an extremely strong vacuum.

A means 60 is carried by UTV 20 for vacuuming and entraining silt fragments 5*a* into a water flow stream 67. As shown in the embodiment of FIG. 1, the vacuum means 60 includes an eductor 61 connected to an elongated suction hose 71. Eductor 61 is actuated by a pump 62 that pumps water from inlet 63 through line 64. The detailed operation of eductor 61 is shown and described in greater detail in my U.S. Pat. No. 6,863,807 issued Mar. 8, 2005 (incorporated herein by reference) and is not repeated here for the sake of brevity. The elongated suction hose 71 in FIG. 1 constitutes a means shown generally as 70 for moving the entrained fragments 5*a* to a location outside the basin such as a permeable dam 72 which accumulates the unwanted silt fragments 5*a* which are disposed of in any number of acceptable ways.

A means shown generally as 80 for continuously sensing the location of UTV 20 as it moves along the basin floor is a sonar unit 81 that sits on the floor 4 of the basin on legs 82. Sonar 81 emits periodic waves 83 as known in the sonar art that impact UTV 20 and the reflected waves received by the fixed sonar unit 81 records the instantaneous location of UTV 20 and transmits its signal through line 84 to a central control 95 having a joy stick control handle 96 for controlling the motion of UTV 20. The sonar unit 81 remains fixed so long as the UTV 20 is operating in basin 1 in a "line of sight" with sonar 81. In basins having berms, as described below, sonar 81 must be moved periodically to maintain a "line of sight" to UTV 20. For repeated cleanings of basin 1, it is advantageous to position sonar 81 in basin 1 with a boat mounted GPS sensor 85 so that the sonar 81 can either be positioned in exactly the same spot on the basin floor 4 each time the same basin is cleaned or positioned at a precise spot on the basin floor 4.

A means 90 for continuously guiding the UTV 20 along the basin floor in a pattern of motion to remove the accumulated silt from all or a portion of the basin floor is a side scanning sonar 91 that emits periodic sonar waves 92 toward the basin floor adjacent the UTV 20 and processes the reflections of those waves which indicate the condition of the basin floor. Of particular interest, and as described further below, the side scanning sonar 91 searches for the "edge" of the silt layer 5 that was most recently treated by the UTV 20.

The embodiment shown in FIG. 1 utilizes a single row of harrow blades including individual blade 41. Alternate forms of the invention are described below having mechanical cutters and/or lifters mounted both fore and aft of vacuum hood 65, allowing the UTV to move forward and backward along the basin floor without having to make a 180° turn between rows. The use of a single row of harrow blades, as illustrated in FIG. 1, either requires that the UTV 20 must turn through 180° each time it reaches the end of a row or the UTV must clean a section of the basin floor by moving in a rectangular, circular or other pattern which allows the UTV to avoid making 180° turns.

Figure 2:
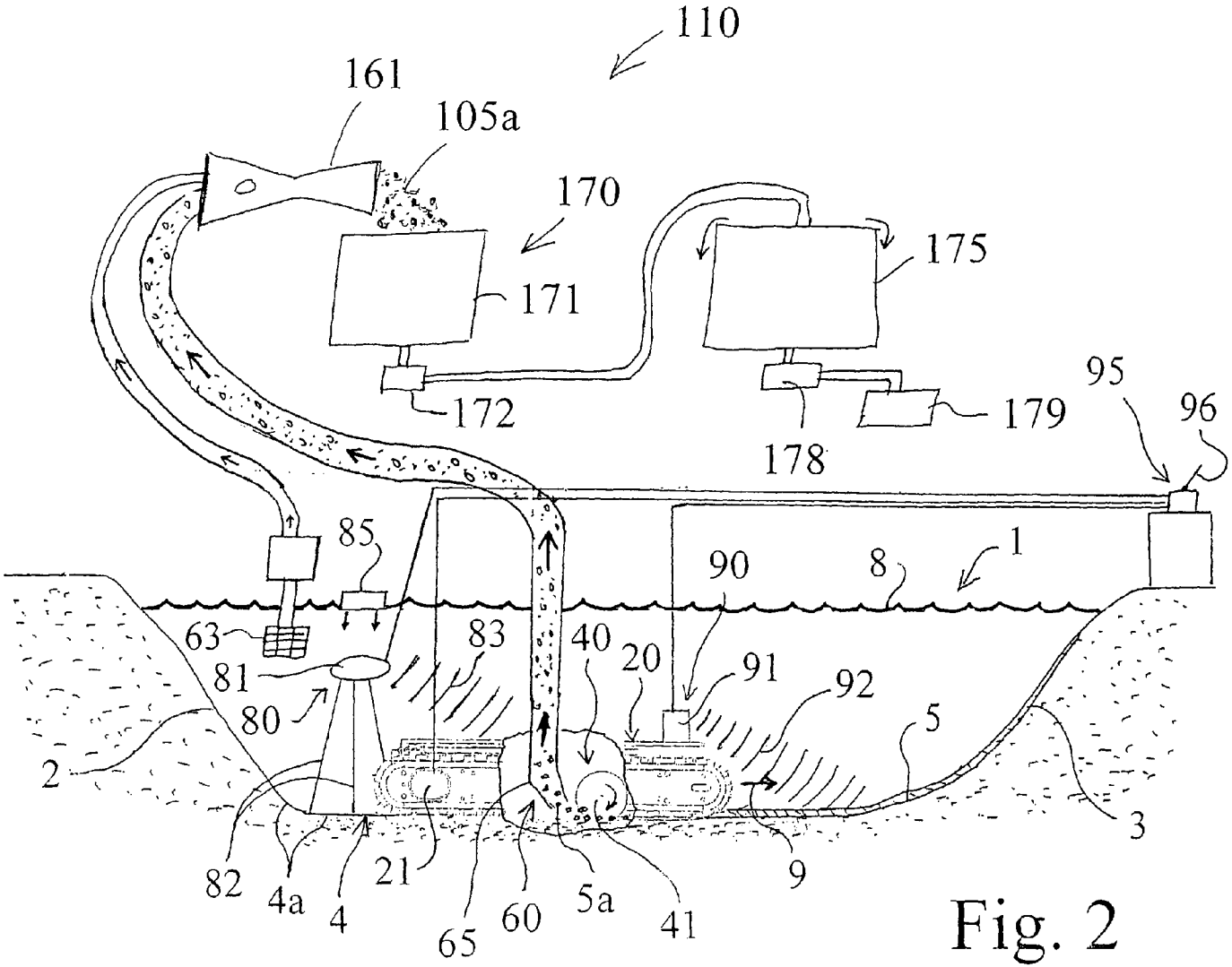
FIG. 2 is a schematic illustration (not to scale) of an alternate embodiment of the invention wherein the removed and fragmented silt is transferred to a clarifying system including a plurality of holding tanks.

As the UTV moves in the direction of arrow 9 in FIG. 1, a person operating joy stick 96 views a monitor (not shown) which displays the condition of the silt layer 5 immediately in front of and adjacent the UTV 20. The user actuates joy stick 96 to guide the UTV. Joy stick 96 is connected to the drive mechanism control 21 of UTV 20 through line 22. The joy stick 96 controls all aspects of the motion of UTV 20, including speed control, directional control, reversing and stopping. The UTV chassis is preferably the "MiniTrac" available from Inuktun Services Ltd. and further information is available at the Website www.inuktun.com FIG. 2 is a schematic illustration showing a second embodiment of the apparatus 110 operating in the basin 1 of FIG. 1, and having the identical UTV 20 of FIG. 1 and sonar controls 80 and 90. The only difference in the apparatus 110 shown in FIG. 2 is that eductor 161 discharges a water stream carrying fragmented silt 105*a* into a clarifying means 170 which includes a holding tank 171 that temporarily collects and stores the output of eductor 161. A variable speed electric pump 172 periodically transfers the contents of holding tank 171 into clarifier 175. Chemical means known in the art are applied to clarifier 175 to separate a very high percentage of silt suspended in the water. Clarified water spills over the top of clarifier 175 and returns into basin 1. The separated and highly concentrated silt remaining in the bottom of clarifier 175 is periodically pumped from clarifier 175 by variable speed electric pump 178 into a clay storage tank 179, which may alternately be a dump truck or storage area on the ground. The clay (or other type of silt) is disposed of by a variety of means known in the art.

Figure 3:
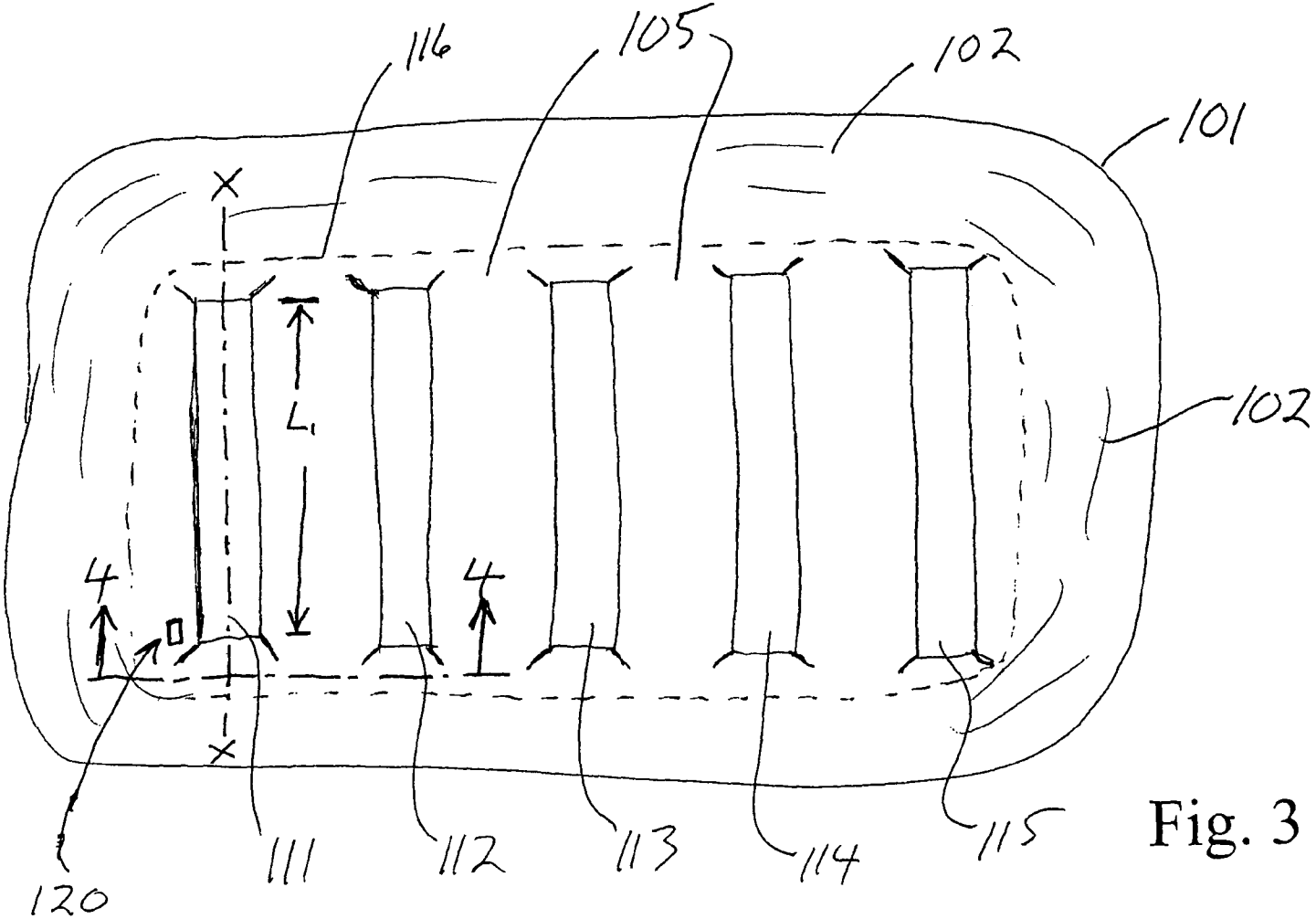
FIG. 3 is a plan view of a water percolation basin having a series of elongated berms formed on its floor.

FIG. 3 is a schematic illustration, not to scale, of a generally rectangular percolation basin 101 having inclined side walls 102. The floor of the basin 105 is flat except for a plurality of longitudinally extending berms 111-115. Berm 111 (and each of the other berms as well) has a longitudinally extending axis X-X. The purpose of berms 111-115 is to increase the surface area of the bottom of basin 101 in order to increase the cross-sectional area into which water may percolate downwardly into the water table. Dashed line 116 illustrates the intersection of the inclined side walls with the flat floor 105 of basin 101. A UTV 120 is illustrated in position on an inclined side wall 111*a* of berm 111, as shown best in FIG. 4.

Figure 4:
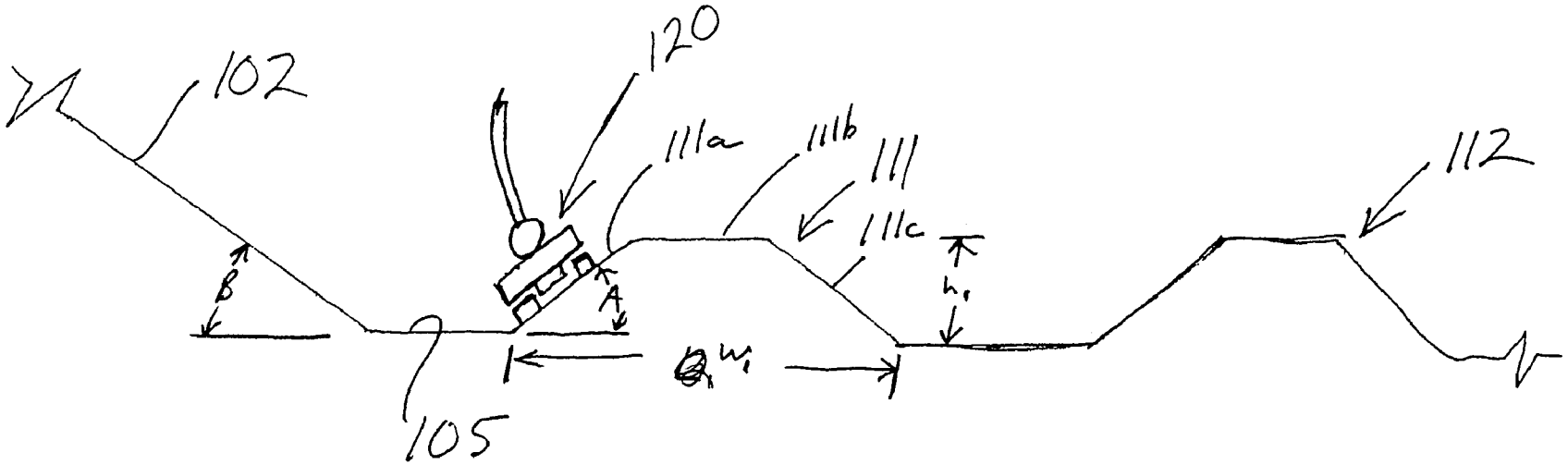
FIG. 4 is a section on the line 4-4 of FIG. 3.

FIG. 4 is a section on the line 4-4 of FIG. 3 and shows UTV 120 (not to scale and greatly enlarged) as it is moving parallel with the longitudinal axis X-X of berm 111. Side wall 111*a* forms an angle A with the floor 105 of approximately 40°. The inclined side wall 102 forms an angle B with the floor 105 of approximately 30°. Berm 111 has a height $h_1$, typically between 2 and 10 feet and a width $W_1$ of between 10 and 15 feet. Berm 111 has a length $L_1$ (see FIG. 4) which may be several hundred feet. The top surface of each berm typically is formed as an edge which becomes rounded and somewhat flattened over time. Inclined side wall 111*c* is similar to inclined side wall 111*a*.

The UTV 120 of the present invention operates on berms 111-115 by moving parallel with the longitudinal axis X-X of each berm. When cleaning an inclined side wall, such as 111*a*, the UTV operates at the relatively steep angle of 40°. When cleaning the floor 105 of basin 101, the UTV 120 preferably travels in pathways parallel to longitudinal axis X-X of the berms of the particular basin. When cleaning the inclined side walls 102 of the basin, the UTV operates along the incline as it is shown operating in FIG. 4. In operating on such an incline, we have found it advantageous to equip the UTV with carbide studs in each of the treads of the track. The studs may extend downwardly between approximately 0.5 inch and 1.0 inch in depth.

Figure 5:
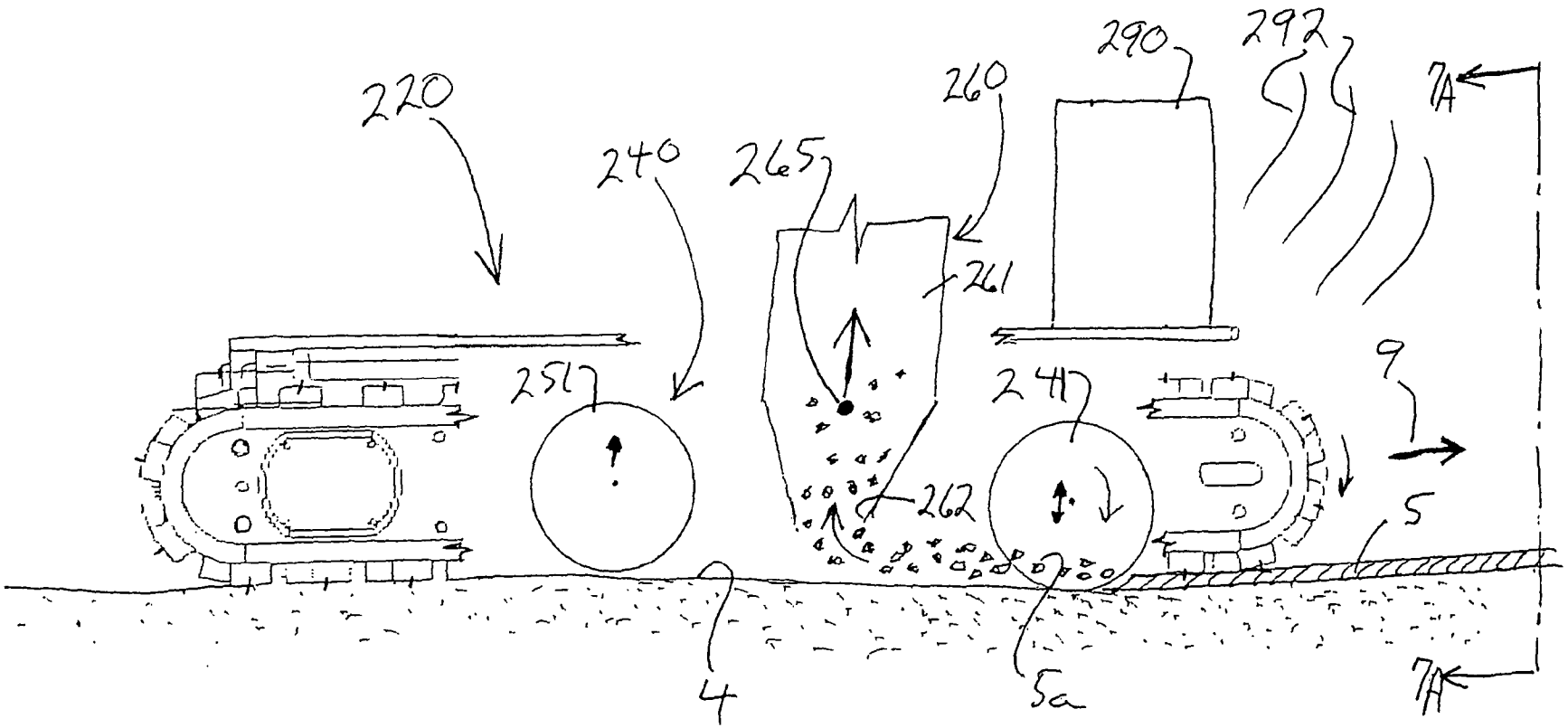
FIG. 5 is a schematic illustration, partially broken away, to illustrate one embodiment of the UTV (underwater terrain vehicle) utilized in the invention.

FIG. 5 illustrates schematically an alternate UTV design shown generally as 220 incorporating alternate means 240 for mechanically cutting and lifting the layer of silt 5. Two rows of harrow blades are provided including individual blades 241 and 251 visible in FIG. 5. The use of two rows of harrow blades allows the UTV 220 to move forwardly and in reverse without having to turn through 180°. Each row of harrow blades is optionally vertically adjustable to vary the depth of the cut. As shown in FIG. 5, the UTV is moving to the right, as shown by arrow 9, and the forward harrow blade 241 is shown in its extended, downwardly projecting position wherein the blade 241 contacts and cuts and slightly lifts the silt layer 5. The rear or downstream harrow blade 251 is shown in its retracted position wherein it rides along the surface 4 without cutting surface 4 after the silt layer 5 has been removed. Each row of harrow blades may be suspended from the frame of UTV 20 by means known in the art to cause the row of blades to move downwardly when cutting and to ride upwardly when not cutting.

The eductor driven vacuum hood 260 shown in FIG. 5 is preferably pivotal about pivot 265 which allows the tip 262 of hood 261 to be articulated. In this fashion, the tip of vacuum hood 261 can be brought closer to the point where harrow blade 241 is cutting and forming silt fragments 5*a*.

Figure 6A:
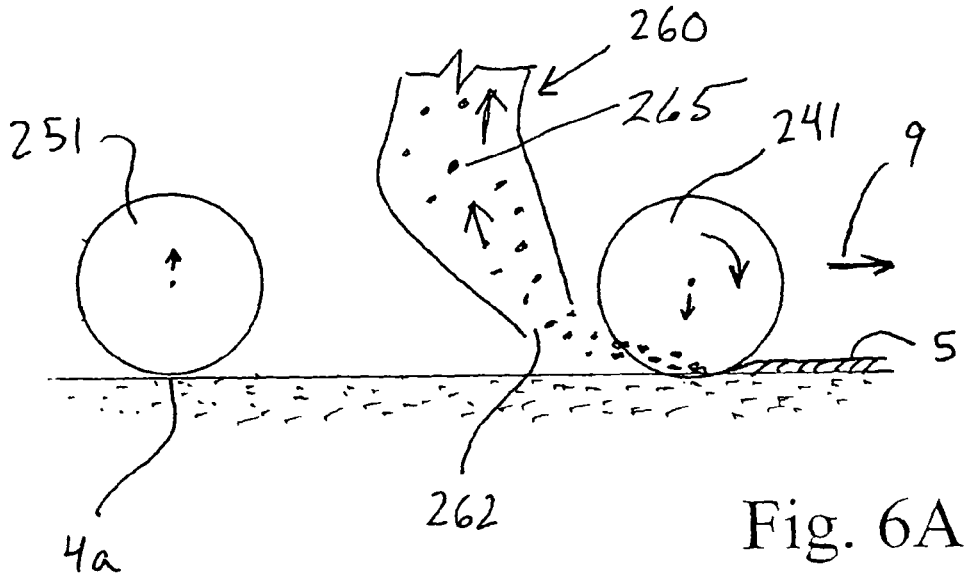
FIGS. 6A and 6B are schematic illustrations showing an optional vacuum head which is pivotally mounted and articulates between the positions shown in FIG. 6A to that shown in FIG. 6B.
Figure 6B:
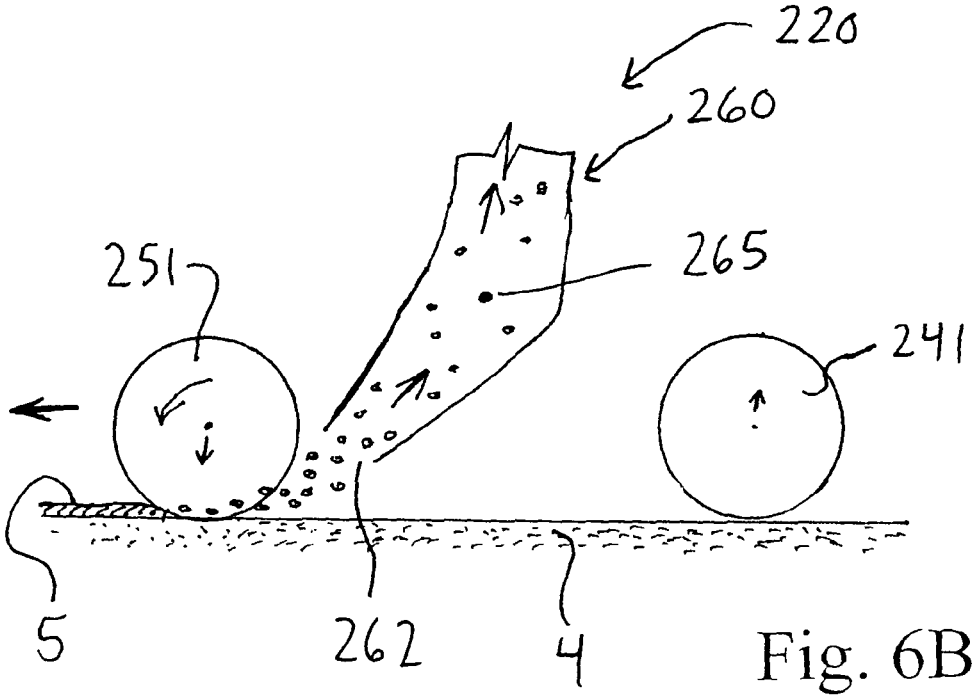

FIG. 6A illustrates schematically how the lower tip 262 of vacuum means 260 is pivoted toward harrow blade 241 when the UTV is moving to the right as shown by arrow 9 in FIG. 6A. Similarly, FIG. 6B illustrates how the lower tip 262 is inclined toward the leading harrow blade 251 as the UTV 220 is moving to the left or in the reverse or opposite direction from that shown in FIG. 6A.

The advantage of using first and second rows of blades such as harrow discs or plow tips allows the UTV to operate in forward and reverse without having to make 180° turns. The advantage of allowing the vacuum tip 262 to pivot as shown in FIGS. 6A and 6B provides a more efficient vacuuming performance, particularly when operating with dense and thick layers of clay as the layer of silt 5.

Figure 7A:
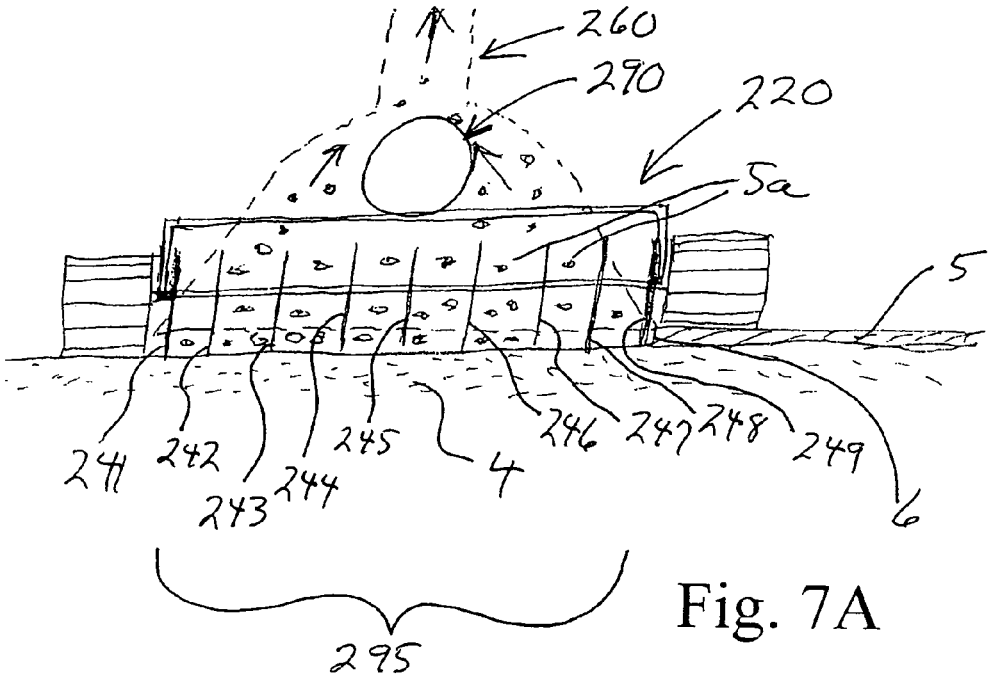
FIG. 7A is a view of the apparatus of FIG. 5 along the lines 7A-7A.

FIG. 7A is a schematic illustration on the line 7A-7A of FIG. 5. Parts of the UTV chassis are broken away for the sake of illustration. The front row of harrow blades 241-249 is shown interacting with silt layer 5. Silt fragments 5*a* are shown being sucked up into eductor head 260 which is shown in phantom for clarity. Side scanning sonar 290 is scanning forwardly as UTV 220 is moving to the right in FIG. 5 and toward the viewer in FIG. 7A. A vertical "edge" 6 of silt layer 5 is formed by the action of harrow blades 241-249.

Figure 7B:
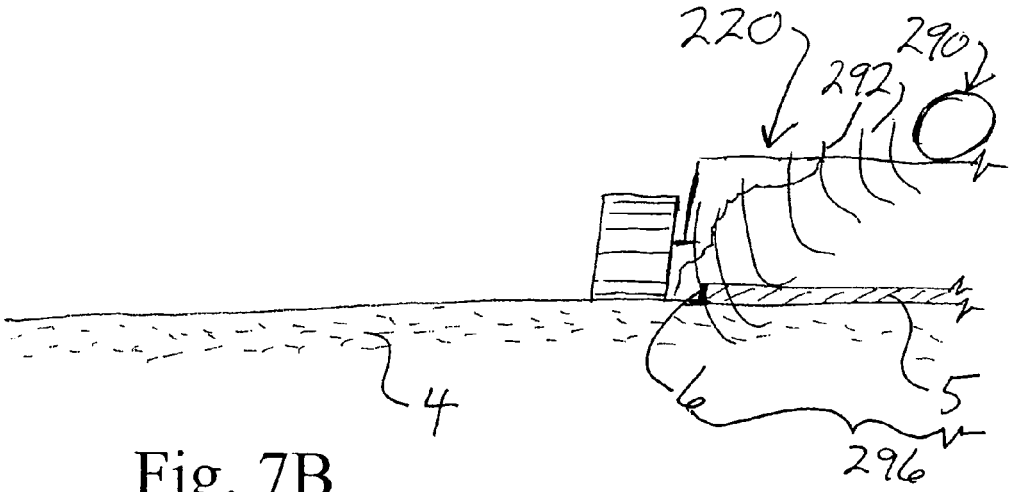
FIG. 7B is a schematic illustration of the apparatus shown in FIG. 7A moving in the opposite direction from that shown in FIG. 7A and cutting a new swath of silt.

FIG. 7B illustrates UTV 220 moving in the opposite direction from that shown in FIG. 7A and in FIG. 5. In FIG. 7B the UTV is moving in a direction away from the viewer. The side scanning sonar 290 is illustrated schematically and the eductor head and harrow blades are not shown for the sake of clarity. FIG. 7B illustrates how sonar 290 emits waves 292 to search for and use the edge 6 as a guide. In FIG. 7A, the UTV is forming a first swath 295 from which a layer of silt 5 is removed, exposing the sandy and permeable basin floor 4. FIG. 7B is illustrating the UTV forming a second swath 296 as the UTV moves in the opposite direction without having to make a 180° turn.

Figure 8:
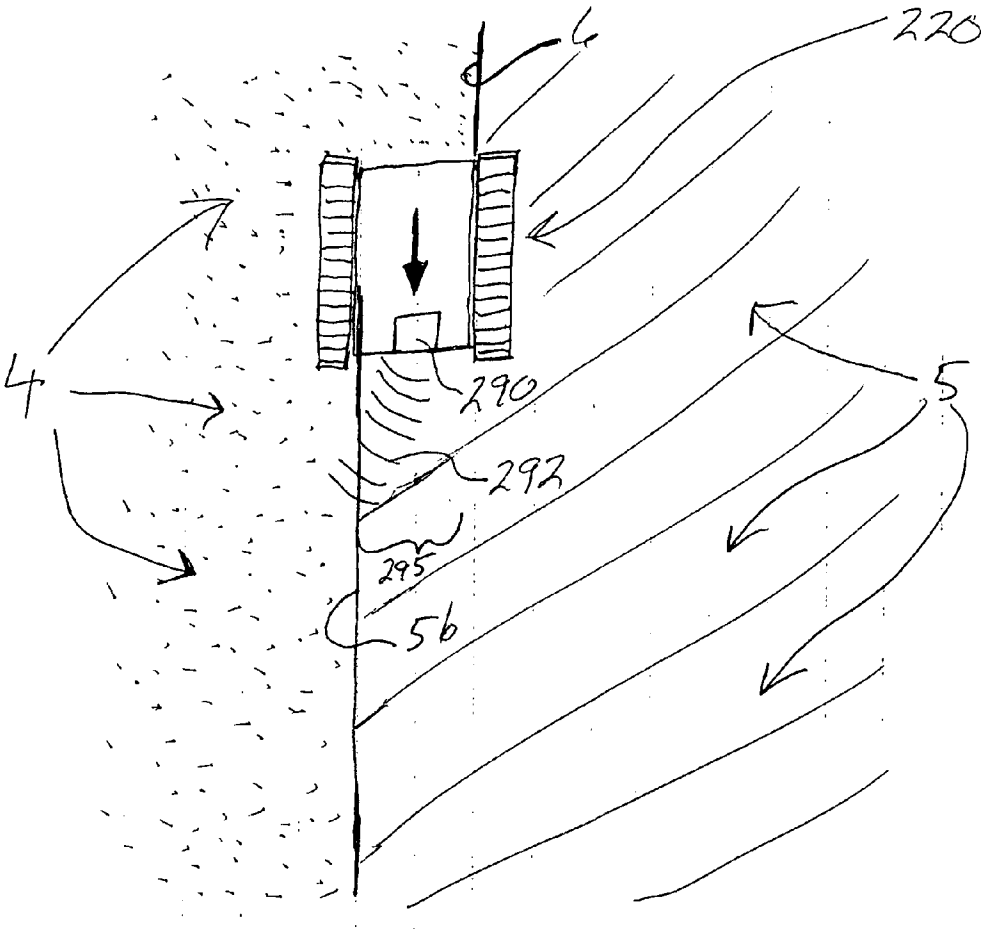
FIG. 8 is a schematic representation of the UTV in which the side scanning sonar is highlighted as it searches for a freshly cut edge of silt layer 5 for guiding the UTV.

FIG. 8 is a schematic representation of UTV 220 of FIG. 7A in the process of cutting a swath 295 from the accumulated silt 5 to expose the sandy and permeable basin floor 4. Sonar 290 is emitting waves 292 to locate the previously formed edge 5*b* of silt layer 5 and is forming the new "edge" 6, as shown in FIG. 7A.

Figure 9:
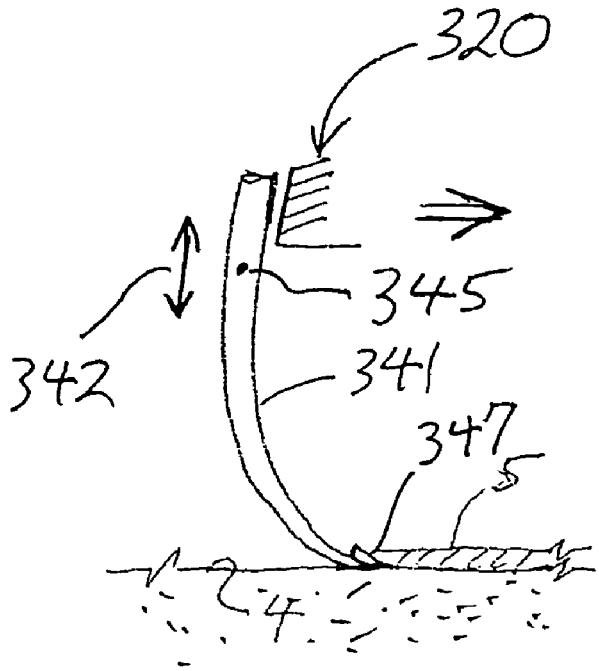
FIG. 9 is an illustration of an alternate type of blade used in conjunction with the invention moving toward the right in FIG. 9 and cutting and lifting accumulated silt.
Figure 10:
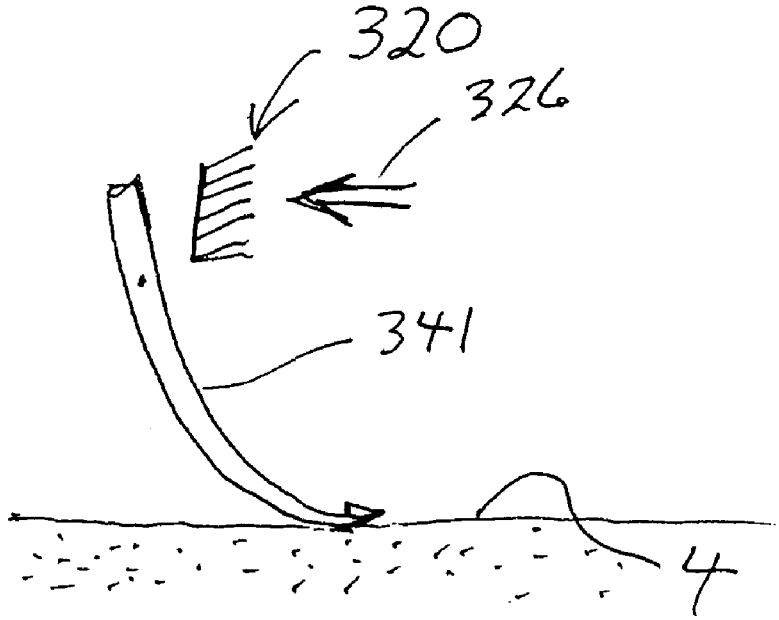
FIG. 10 illustrates the cutting blade or chisel plow of FIG. 9 as it is moving to the left as shown in FIG. 10 and simply riding along the basin floor.

Various types of blades can be utilized to cut and/or lift the accumulated silt layer 5. For example, FIGS. 9 and 10 illustrate schematically a pivotable chisel-type plow blade 341. Blade 341 is pivotally mounted at point 345. Plow tip 347 is triangular in shape. As shown in FIG. 9, the chassis of UTV 320 is utilized to maintain blade 341 in its cutting position, illustrated in FIG. 9. As shown in FIG. 10, as the UTV 320 moves in the opposite direction, as shown by arrow 326, plow blade 341 pivots to the position shown in FIG. 10 and simply rides along the sandy surface 4 of the basin floor. In FIG. 10, the other row of blades (not shown) is performing the cutting, as described above, and blade 341 is allowed to pivot to a retracted position in FIG. 10 to minimize disturbance to the sandy permeable-basin floor 4. Plow blades such as 341 are adjustable in height as shown by arrow 342 in FIG. 9.

Figure 11:
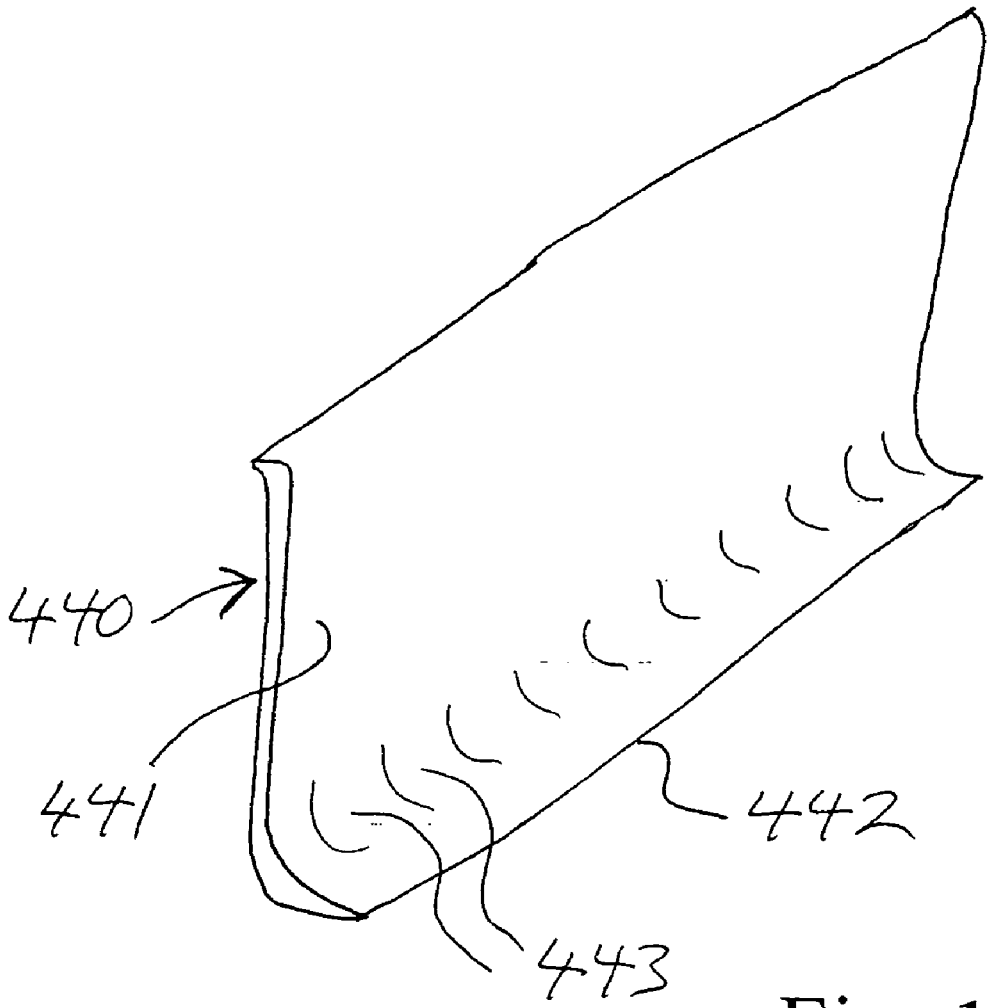
FIG. 11 is a perspective view of a single bulldozer-type blade for use in some basins.

FIG. 11 shows an alternate blade 440 usable with the invention where the blade is a single piece bulldozer-type blade having a generally vertically upstanding section 441. A relatively sharp leading edge 442 and a curved or sloped intermediate region 443 are provided, as known in the art for cutting and lifting a swath of material. A single wide blade, such as illustrated in FIG. 11, is not as effective in sticky or fatty clay as chisel blades or harrow disc blades as illustrated and described above. However, a single blade 440 may be usable as local conditions permit.

Figure 12:
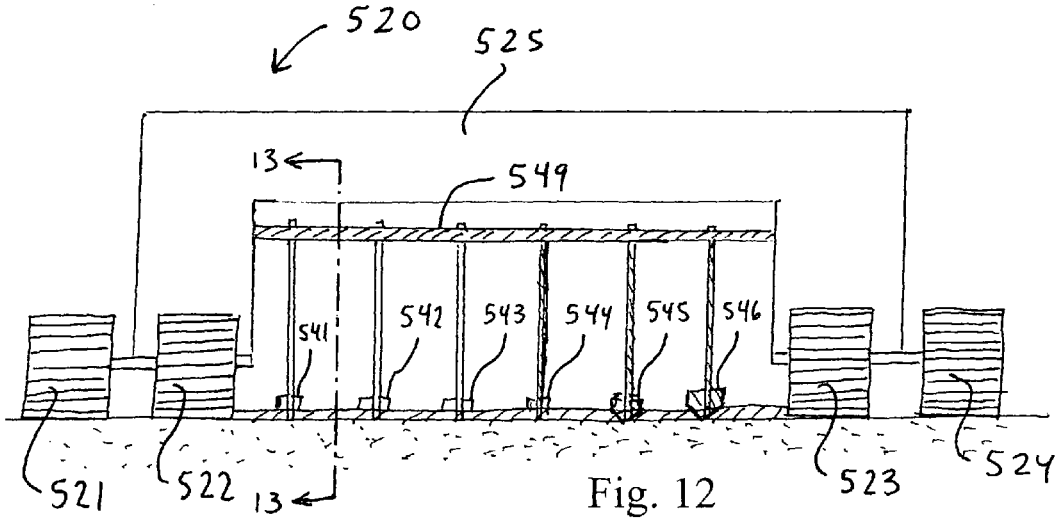
FIG. 12 is a schematic representation of an alternate embodiment of the UTV utilizing four treads and carrying an alternate design of cutting blades.
Figure 13:
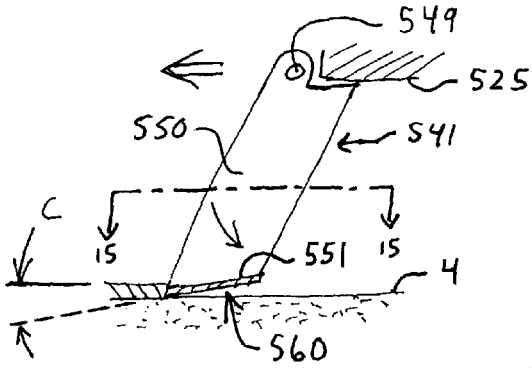
FIG. 13 is a view on the line 13-13 of FIG. 12 showing a single dragon-tooth cutting blade.
Figure 14:
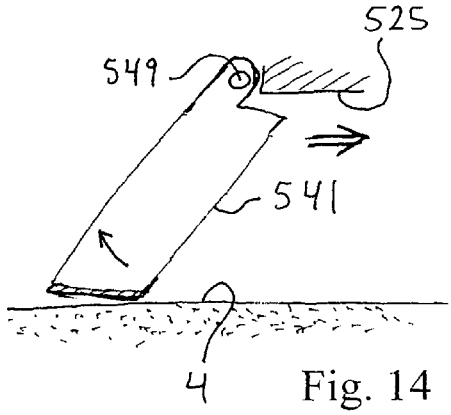
FIG. 14 illustrates the blade of FIG. 13 when the UTV is moving in the opposite direction.
Figure 15:
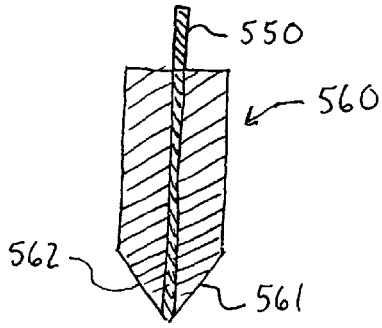
FIG. 15 is an elevational view along the line 15-15 of FIG. 13.

FIGS. 12-15 illustrate a further embodiment of UTV 520. UTV 520 is illustrated with a total of four treads 521-524, wherein two treads are on each side of the chassis 525. The additional treads are utilized where increased traction is necessary. FIG. 12 illustrates an alternate type of, what we refer to as, "dragon-tooth" blades 541-546. These blades are suspended from a bar or rod 549 connected to the chassis 525 of UTV 520. As shown in FIG. 13, individual dragon-tooth 541 includes a generally flat body 550 which carries a blade 560 along its lower edge 551. The lower edge 551 of body 550 is formed to create an acute angle C with the basin floor 4 of between approximately 2° and 10°. The purpose of acute angle C is to allow blade 560 to cut and lift sections of accumulated silt as described above. As shown best in FIG. 15, body 550 carries and supports inclined blade 560. Blade 560 has forward cutting edges 561 and 562 that form angles of approximately 45° with body 550. The body 550 and blade 560 are preferably formed of stainless steel and the design illustrated in FIGS. 13-15 minimizes the expense of each of the blades such as 541. Blade 541 may be pivotally mounted to rod 549 and suspended from chassis 525 to cause blade 541 to be in its downwardly extending position shown in FIG. 13 when the chassis is moving to the left in FIG. 13. As shown in FIG. 14, when the chassis 525 of UTV is moving to the right, blade 541 simply rotates clockwise relative to suspension rod or bar 549 and rides along basin floor 4.

Figure 16:
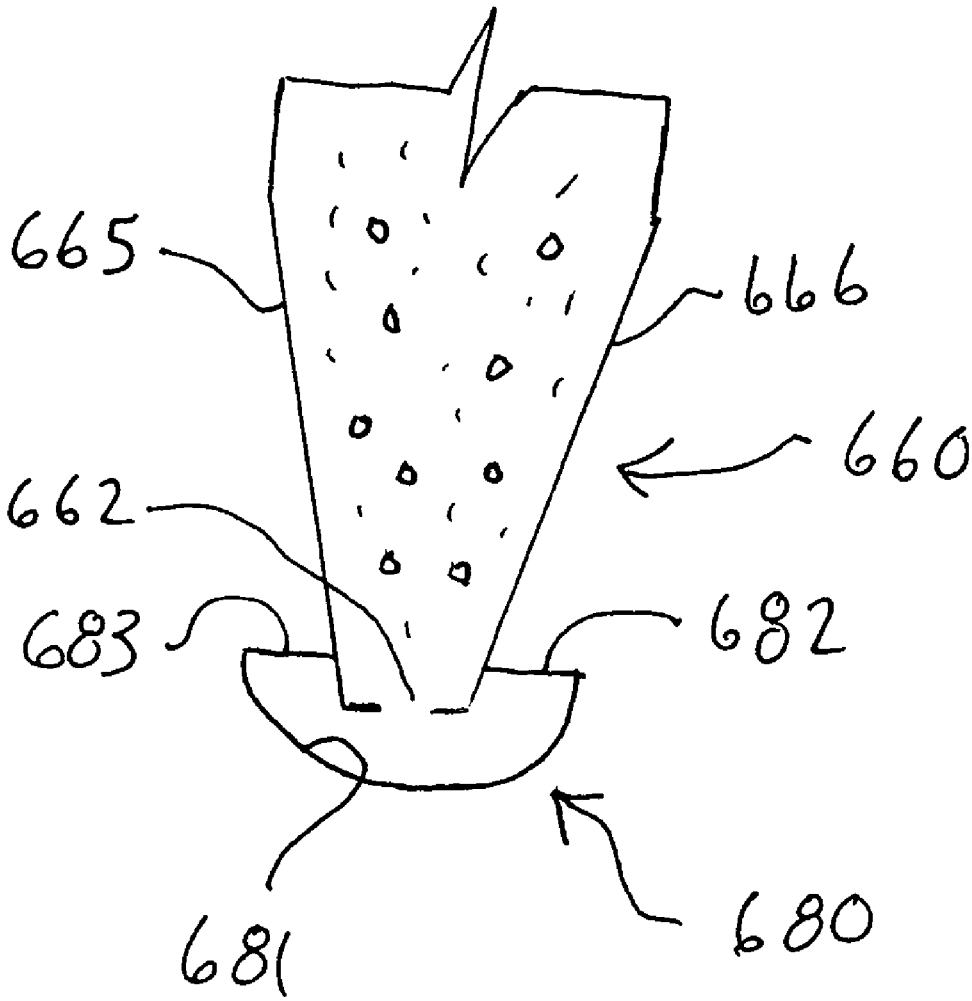
FIG. 16 is a schematic illustration of an alternate eductor vacuum head carrying a protective screen to prevent clogging of the mouth of the vacuum.

As shown in FIG. 16, the vacuum hood 660 is preferably formed with a protective screen 680 covering the vacuum inlet 662. The purpose of screen 680 is to prevent rather large particles from clogging or blocking the vacuum inlet 662. For example, screen 680 is typically formed of a mesh material that will prevent rocks or other non-fragmentable debris larger than approximately 0.5 inch from passing through screen 680 and possibly blocking the mouth 662. Mouth 662 may have an opening that is approximately 1 inch in width to accept particles that will pass through a 1 inch rectangular grid. Screen 680 preferably extends below mouth 662 and forms a generally C-shaped lower section 681. C-shaped section 681 extends downwardly below mouth 662 of vacuum head 660. Screen 680 has upper portions 682 and 683 that are rigidly connected to the side walls 665 and 666 of vacuum head 660.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A method for removing accumulated silt from the floor of a water percolation basin, utilizing a remotely controllable underwater terrain vehicle (UTV), wherein said UTV carries a silt cutting and/or lifting mechanism, and wherein said UTV carries an eductor driven water vacuum head, comprising the steps:

moving said UTV along said basin floor, mechanically cutting and/or lifting accumulated silt from said basin floor to form silt fragments, without fluidizing or hydraulically agitating the basin floor, as said UTV moves along said basin floor, vacuuming and entraining said silt fragments in a water flowstream with said eductor driven water vacuum head carried by said UTV, without having to separate larger size particles from said entrained silt fragments and returning those larger size particles to said basin floor, moving said entrained fragments directly to a location outside said basin, continuously sensing the location of said UTV as it moves along said basin floor, and continuously guiding said UTV along said basin floor in a pattern of motion to efficiently remove said accumulated silt from all or a portion of said basin floor.

2. The method of claim 1 further comprising the steps of:

continuously sensing the basin floor adjacent said UTV with a side scanning sonar device carried by said UTV, and guiding said UTV in response to feedback from said side scanning sonar.

3. The method of claim 2 wherein the location of said UTV is continuously sensed by a second sonar unit placed at a known location underwater in said basin.

4. The method of claim 3 wherein said second sonar unit is placed in a known location in said basin using a GPS sensor.

5. The method of claim 2 wherein as said UTV moves along the basin floor and removes a swath of silt, an edge of said swath is formed and wherein said side scanning sonar carried by said UTV continuously searches for and is guided by said edge of a swath previously formed.

6. The method of claim 1 comprising the further step of transferring said entrained silt fragments into a clarifier and returning clarified water into said basin.

7. The method of claim 1 wherein said basin floor has a plurality of elongated berms, each berm having inclined side walls and a longitudinal center line, and wherein said UTV moves along pathways parallel to said center line of each of said berms.

8. The method of claim 1 wherein said UTV carries a single row of blades for cutting and/or lifting said silt, and wherein said water vacuum head is adjacent said single row of blades.

9. The method of claim 1 wherein said UTV carries first and second rows of blades, said vacuum head is carried between said first and second rows of blades, and wherein said UTV moves in a pattern of moving forwardly to form a first swath and backwardly to form a second swath.

* * * * *